United States Patent [19]

Mulholland, deceased et al.

[11] 4,047,357

[45] Sept. 13, 1977

[54] ROOF STRUCTURE OF CONCRETE EDGE-TO-EDGE ABUTTING PANELS AND METHOD OF INTERCONNECTING SAME

[76] Inventors: Stanley C. Mulholland, deceased, late of Rochester, Minn.; Wanda E. Mulholland, administratrix, Mr 73, Box 168, Rochester, Minn. 55901

[21] Appl. No.: 661,142

[22] Filed: Feb. 25, 1976

Related U.S. Application Data

[63] Continuation of Ser. No. 502,345, Sept. 3, 1974, abandoned.

[51] Int. Cl.[2] ..... E04B 7/04

[52] U.S. Cl. ..... 52/90; 52/309.4; 52/405; 52/587; 52/602; 52/747

[58] Field of Search ..... 52/309, 585, 602, 599, 52/405, 90, 92, 747, 587, 396

[56] References Cited

U.S. PATENT DOCUMENTS

| | | | |
|---|---|---|---|
| 1,819,405 | 8/1931 | Brooks | 52/602 X |
| 1,891,763 | 12/1932 | Henderson | 52/602 |
| 2,097,781 | 11/1937 | Venzie | 52/599 X |
| 2,159,991 | 5/1939 | Hilpert | 52/602 |
| 2,244,343 | 6/1941 | Meyercord | 52/585 |
| 2,466,106 | 4/1949 | Hoye | 52/587 X |
| 2,592,634 | 4/1952 | Wilson | 52/405 X |
| 2,838,144 | 6/1958 | MacDonald | 52/585 |
| 3,110,981 | 11/1963 | Larner | 52/309 |
| 3,141,206 | 7/1964 | Stephens | 52/406 X |
| 3,277,219 | 10/1966 | Turner | 52/309 |
| 3,423,891 | 1/1969 | Burris | 52/92 X |
| 3,435,580 | 4/1969 | Merrill et al. | 52/405 |
| 3,786,611 | 1/1974 | Brown et al. | 52/309 X |
| 3,834,095 | 9/1974 | Ohlson | 52/587 |
| 3,845,593 | 11/1974 | Zen | 52/602 X |
| 3,943,676 | 3/1976 | Ickes | 52/309 |

FOREIGN PATENT DOCUMENTS

| | | | |
|---|---|---|---|
| 217,138 | 9/1958 | Australia | 52/585 |

*Primary Examiner*—Leslie Braun
*Attorney, Agent, or Firm*—Mark W. Gehan

[57] ABSTRACT

Preformed concrete panels are described for use in the construction of buildings. Roof panels are designed such that they have self-sealing abutting edges when assembled, and the roof panels interlock with wall panels and, preferably, with other roof panels supported by a center building beam. One type of wall panel has a support member projecting form one surface which is adapted to support a floor structure.

7 Claims, 10 Drawing Figures

ROOF STRUCTURE OF CONCRETE EDGE-TO-EDGE ABUTTING PANELS AND METHOD OF INTERCONNECTING SAME

Cross-Reference to Related Application

This application is a continuation of copending application Ser. No. 502,345, filed Sept. 3, 1974, now abandoned.

This invention relates to building construction and, more specifically, to preformed concrete panels used in building construction.

Although others have previously proposed preformed concrete panels for use in building construction, such panels have not been totally satisfactory for a number of reasons. Some of such panels are expensive or difficult to fabricate and other known panels are difficult both to insulate or weatherproof after assembly of a building structure. Still other panels require considerable labor to assemble in the form of a building. The present invention provides building panels which alleviate the foregoing problems and deficiencies associated with prior art panels.

SUMMARY OF THE INVENTION

In accordance with the present invention there is provided a preformed concrete building panel having a downwardly projecting rib extending along each of two opposite side edges on the bottom surface of said panel, each rib being integral with said bottom surface. A layer of foam covers the bottom surface of the panel and extends around each rib so as to at least partially cover opposite side edges of the panel. The ribs are thicker at their base than at their projecting end. These panels are particularly useful as roof panels. When the panels are arranged in edge-to-edge relation they are self-sealing due to the foam on the panel edges which is compressed between adjacent abutting panels.

The invention also provides a panel comprising a concrete core having a window or door opening therein and having a layer of foam covering at least one surface of the concrete core in such a manner as to form the trim and frame around the window or door opening. The foam layer also serves as the interior wall surface including all trim and moldings with no further finishing required other than painting or wallpapering thereof.

When the concrete core has a layer of foam on only one surface it is useful as an exterior wall of a building, and the exposed concrete surface may have a desired surface design embossed therein before the setting of the concrete (e.g., a stucco appearance, siding appearance, etc.). When the concrete core has a layer of foam on both surfaces thereof or is encapsulated in foam it is useful as an interior wall of a building or as a door panel or as some other component in a building structure.

The invention further provides a concrete wall panel useful, for example, as a basement wall having projecting from one surface thereof a support member which is integral with the panel and which is capable of supporting a floor structure. The top edge of the panel is bevelled, and a layer of foam covers the inside surface of the panel including the support member and extends over the bevelled top edge of the panel.

The building panels of this invention are very inexpensive to fabricate and are virtually maintenance-free because the exterior surface is concrete. The panels are quite sound-proof and are a very effective weather-seal due to the seamless nature of the panels. The joints between abutting panels are self-sealing due to the foam on the edges of the panel which is compressed between the panels. The panels are easily and quickly assembled to form a building structure. Since the roof panels are self-locking there is no need for extraneous brackets, bolts, etc. Furthermore, a building structure comprised of panels of this invention may be easily disassembled and relocated elsewhere without undue expense and labor.

The roof panels may be made of any desired size (e.g., 6 feet × 12 feet or 16 feet × 60 feet) with a typical size being 8 feet × 16 feet. Extremely large panels, or panels which are required to support considerable weight in use, may have more than two ribs or supports on their under surface (running lengthwise or crosswise with respect to the panel) for further support. The wall panels may also be of any desired size (e.g., 8 feet × 40 feet, 12 feet × 60 feet, etc.).

Panels of the invention are useful for the construction of a wide variety of structures (e.g., conventional houses, A-frame structures, condominiums, apartment buildings, warehouses, commercial buildings, subways, swimming pools, garages, etc.). Such structures can be made quite quickly and inexpensively with the preformed panels of the invention.

DETAILED DESCRIPTION OF THE INVENTION

The invention is described in more detail hereinafter with reference to the accompanying drawings wherein like reference characters refer to the same parts throughout the several views and in which.

Figure 1:
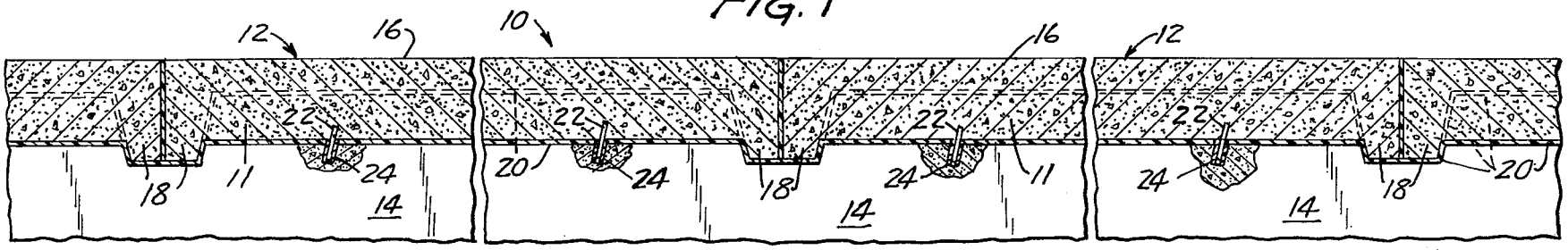
FIG. 1 is a cross-sectional view of a roof structure comprising building panels of the invention in edge-to-edge arrangement.

In FIG. 1 there is shown a cross-sectional view of roof structure 10 comprising preformed concrete building panels 12 arranged in edge-to-edge relationship, one end of panels 12 being supported by wall 14. Of course, the panels 12 could also be supported by beams or columns of conventional type in place of wall 14.

Panels 12 as shown in FIG. 1 comprise body section 16 having a generally flat top surface. Ribs 18 are integral with the body section 16 and project downwardly from the bottom surface thereof, one rib extending along each side of panel 12. Support 11 extends crosswise of panel 12 and rests directly on top of wall 14.

Ribs 18 are slightly tapered (i.e., the thickness of each rib is greater near its base than it is at its projecting end). A layer of insulating foam 20 (e.g. polyurethane foam) covers the bottom surface of body section 16 and extends around ribs 18 so as to at least partially cover the opposite side edges of panel 12.

In the construction of a roof, panels 12 are disposed in edge-to-edge relationship (as shown in FIG. 1). One end of each panel may be supported by a wall 14 having appropriately spaced notches along its top edge, each notch being adapted to receive two abutting ribs 18 of adjacent panels 12. Alternatively, instead of being supported by wall 14, panels 12 may be supported by a series of columns whose top ends are adapted to receive abutting ribs 18 of abutting panels.

Because the notch in the wall (or column) has slanted sides (i.e., the notch is somewhat V-shaped) and because ribs 18 are tapered, abutting panel edges are forced tightly together when they are supported by wall 14. The foam 20, in areas between adjacent abutting panels, is compressed so as to form a water-proof seal between such adjacent panels. Conventional caulking may be used, if desired, to obtain further sealing of the joint. As a further means of assuring that adjacent panels fit tightly together, the bottom surface of the panels may have one or more metal pins 22 anchored therein at an oblique angle. Pins 22 are adapted to slide into corresponding recesses 24 in the top of wall 14.

Because abutting ribs 18 on the under surface of abutting panels 12 are of the same size and shape, these abutting ribs create the appearance of a decorative beam ceiling when viewed from inside the completed building structure. Since the foam on the under surface of the panel made in accordance with this invention is an excellent insulating material and also provides a smooth surface, no further insulation need be applied nor is there any need for finishing work to be done to the ceiling other than painting or decorating.

Figure 2:
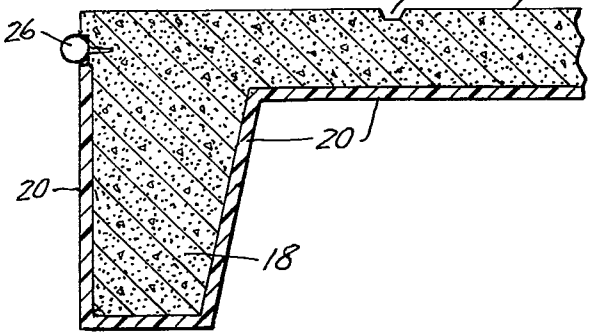
FIG. 2 is a cross-sectional view of a portion of a building panel of the invention.

In FIG. 2 there is shown a cross-sectional view of a portion of building panel 12 illustrating in more detail the foam layer 20 which covers the bottom surface of the panel and extends around rib 18 to at least partially cover the edge of panel 12. On the bottom surface of the panel the foam is typically about one inch or more in thickness while on the edges of the panel the foam is typically about one-fourth to one-half inch thick. If desired, a suitable gasket 26 (e.g., a rubber strip) may be attached to the edge of panel 12 (e.g., by partially embedding it in the concrete of panel 12) for the purpose of providing an additional waterproof seal between adjacent abutting panels in a roof structure. The top surface of the panel may have grooves 21 therein for decorative appearance or for water to follow. The top surface of the panel may be provided with any desired design or decorative configuration.

Figure 3:
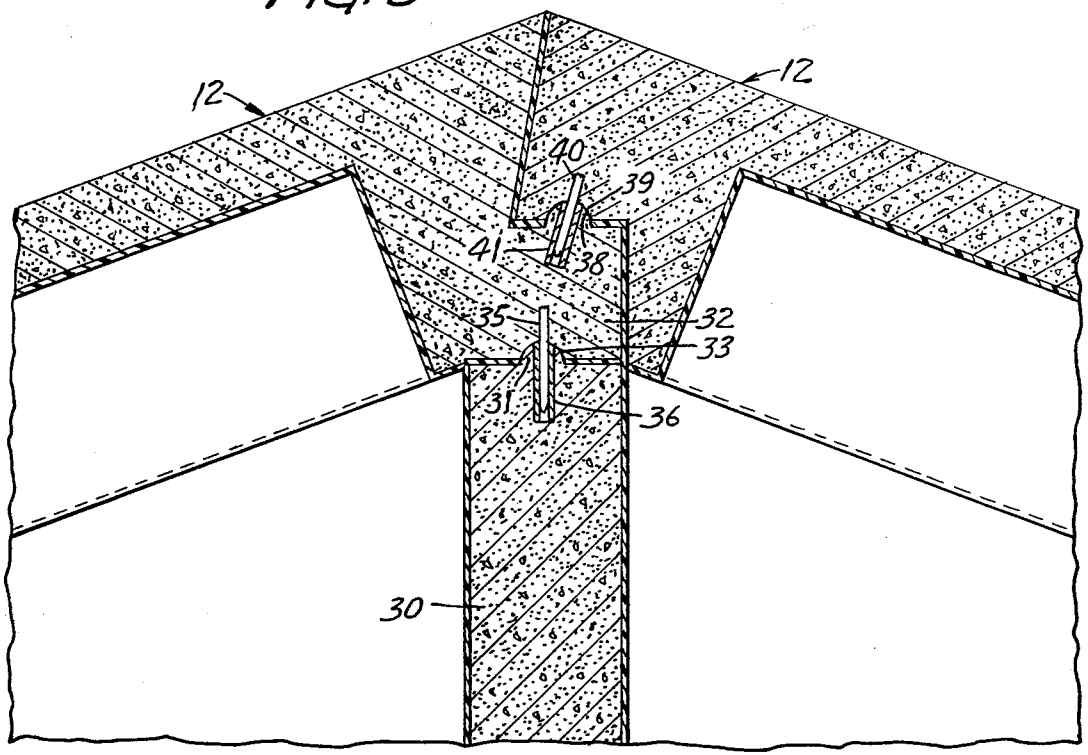
FIG. 3 shows one manner in which roof panels of the invention are interconnected at the peak of a roof.

In FIG. 3 there is shown the preferred manner in which roof panels 12 are interconnected at the peak of a roof on a building structure. Along one end of first panel 12 there is a projecting step or shelf 32 which is integral with the panel. The bottom of step 32 rests upon, and is supported by beam 30 (which runs longitudinally with respect to the building structure). A tongue-in-groove connection formed by hump 31 on beam 30 and recess 33 in the bottom of step 32 assists in holding the panel firmly with respect to beam 30. As a further means of maintaining the panel in rigid relation to beam 30, metal pin 35 is anchored at one end in the bottom of step 32 and the other end of pin 35 slides into recess 36 in beam 30.

The top of step 32 serves as a support for one end of a second panel 12 which has a configuration which is complementary to the end of the first panel. A tongue-in-groove connection formed by hump 38 on the top surface of step 32 (of said first panel) and recess 39 in the bottom surface of said second panel assists in holding said second panel firmly to said first panel. As a further means of holding the second panel rigidly to the first panel, metal pin 40 is obliquely anchored in the bottom of the second panel and recess 41 is provided in step 32 (of the first panel) to receive pin 40.

Figure 4:
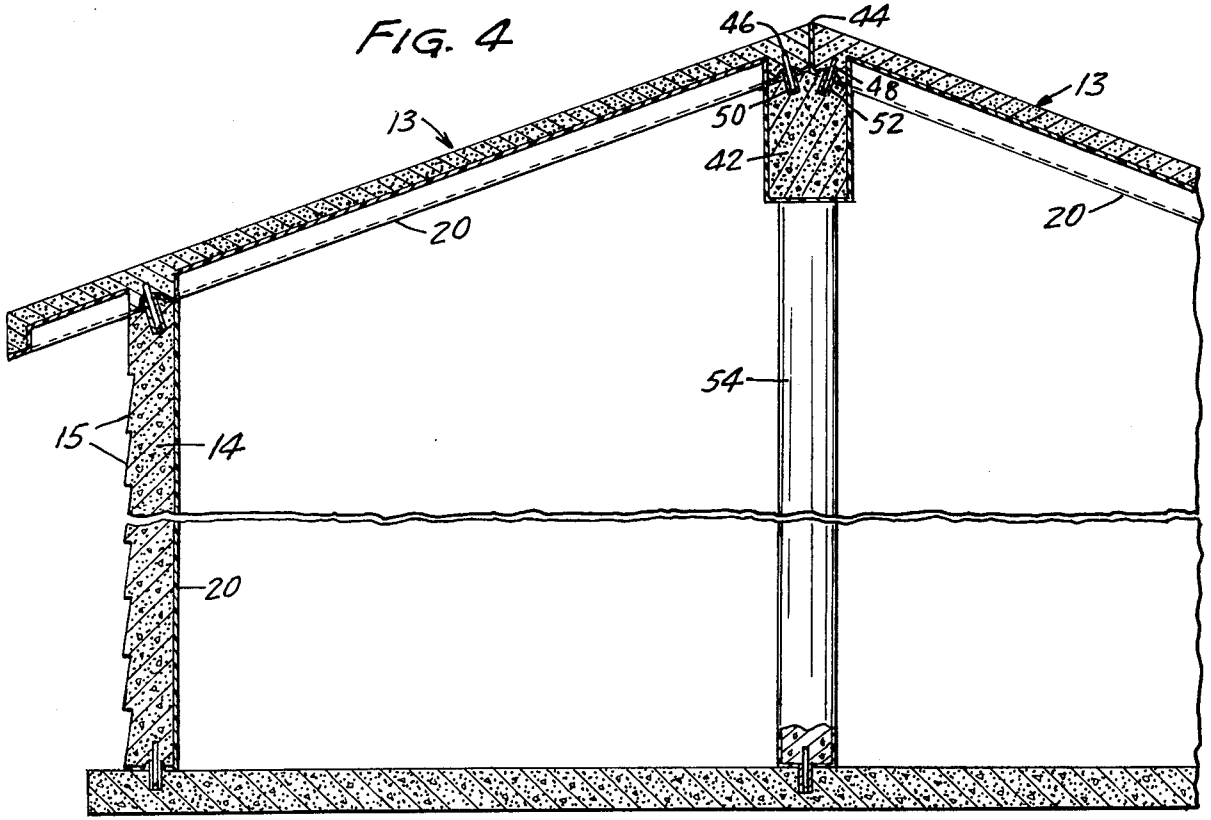
FIG. 4 shows another manner in which roof panels of the invention are interconnected at the peak of a roof and to a wall panel.

In FIG. 4 there is shown another manner in which roof panels of the invention may be interconnected at the peak of a roof. Roof panels 13 are supported at one end by a wall panel 14 having appropriately spaced notches as described above with respect to FIG. 1. Wall 14 also has an embossed exterior 15 resembling siding. Foam 20 covers the interior of wall 14 and the bottom of panels 13.

At the peak of the roof the ends of the two panels 13 which come together are appropriately designed such that they fit flush with essentially no gap therebetween when they rest upon beam 42. Rubber gasket 44 may be positioned between the two ends and compressed by the panels so as to form an effective water-proof seal. Pins 46 and 48 obliquely anchored in the ends of the panels fit into recesses 50 and 52 in beam 42. Beam 42 may be supported, for example, by means of posts or columns 54.

Figure 5:
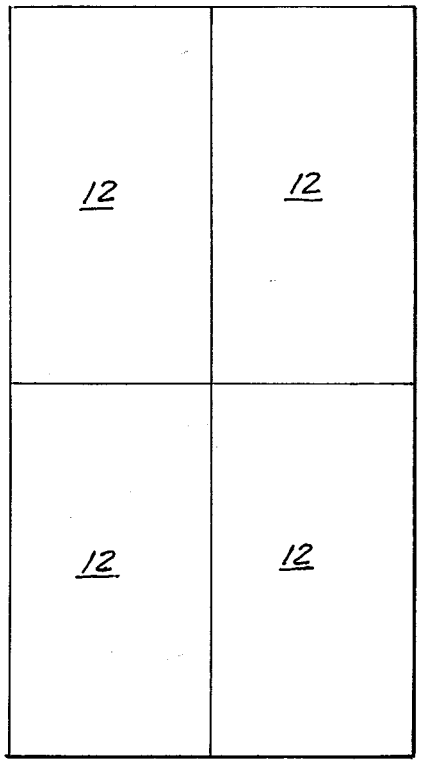
FIG. 5 is a top view of a portion of a roof comprised of four panels of the invention.

FIG. 5 shows a top view of a portion of a roof structure comprised of panels 12 of the invention. Preferably the panels are rectangular in shape, although other geometrical shapes may also be used depending upon the roof shape desired. The panels can be of any size, depending upon the dimensions of the building under construction and the individual desires of the builder.

Figure 6:
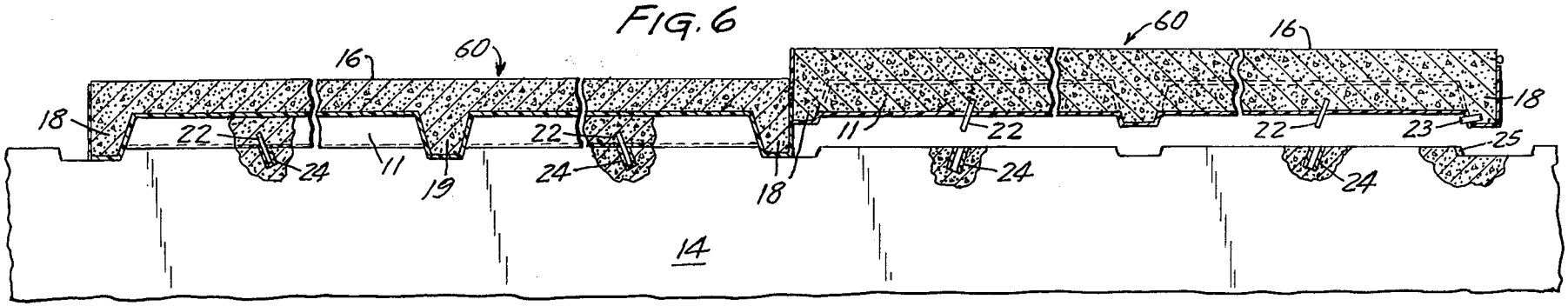
FIG. 6 is a cross-sectional view of another roof structure comprising building panels of the invention.

In FIG. 6, there is shown a cross-sectional view of another roof structure comprising building panels 60 of the invention. Panels 60 comprise body section 16 having a generally flat top surface. Ribs 18 along opposite side edges of panels 60 are integral with body section 16 and project downwardly from the bottom surface thereof. An additional rib 19 (or a plurality of ribs) on the bottom surface of the panel is located between ribs 18. Rib 19 is provided on the bottom surface of the panel when needed for additional panel strength. Rib or support 11 extends crosswise the panel on each end thereof. One end of the panel rests upon the top edge of wall 14 and the other end ordinarily rests upon a beam structure or wall.

Ribs 18 of adjacent panels fit into appropriately spaced notches in wall 14 as described above with respect to FIG. 1. Pins 22 anchored in panels 12 fit into recesses 24 in wall 14 to provide additional rigidity.

If desired, the ribs 18 may form a bar-in-groove connection with the wall 14 as shown. Metal bar 23 anchored in rib 18 is adapted to slide into groove 25 in the notch in wall 14. Of course, the metal bar may be anchored in wall 14 and the corresponding groove may be in rib 18.

The roof panels of this invention are typically made according to the following method. The method involves first placing the wet ingredients for the foam into an appropriately shaped mold, followed by curing of the foam. After the foam has been formed in the mold in a thin layer (e.g., about one inch thick), the exposed surface of the foam is typically cut away or roughened so that concrete will bond firmly thereto. The wet concrete is placed into the mold over the foam layer and permitted to cure thereby forming a bond with the foam. The top surface of the concrete may be formed or provided with a desired design (e.g., grooves may be put therein, etc.). The resulting roof panel may then be used without further preparation. If pins (or bars) are desired in the bottom surface of the panel as shown in FIG. 1, these may be positioned in the mold before pouring the wet concrete therein so that the concrete will harden around the desired pins (or bars).

Another useful method for making the panels involves first putting the wet concrete into an appropriately shaped mold and permitting it to cure. The resulting concrete panel is then spaced an appropriate distance from a mold and the wet ingredients for the foam are injected into this space so that the resulting foam bonds to the surface of the concrete and conforms to the inside surface of the mold.

Figure 7:
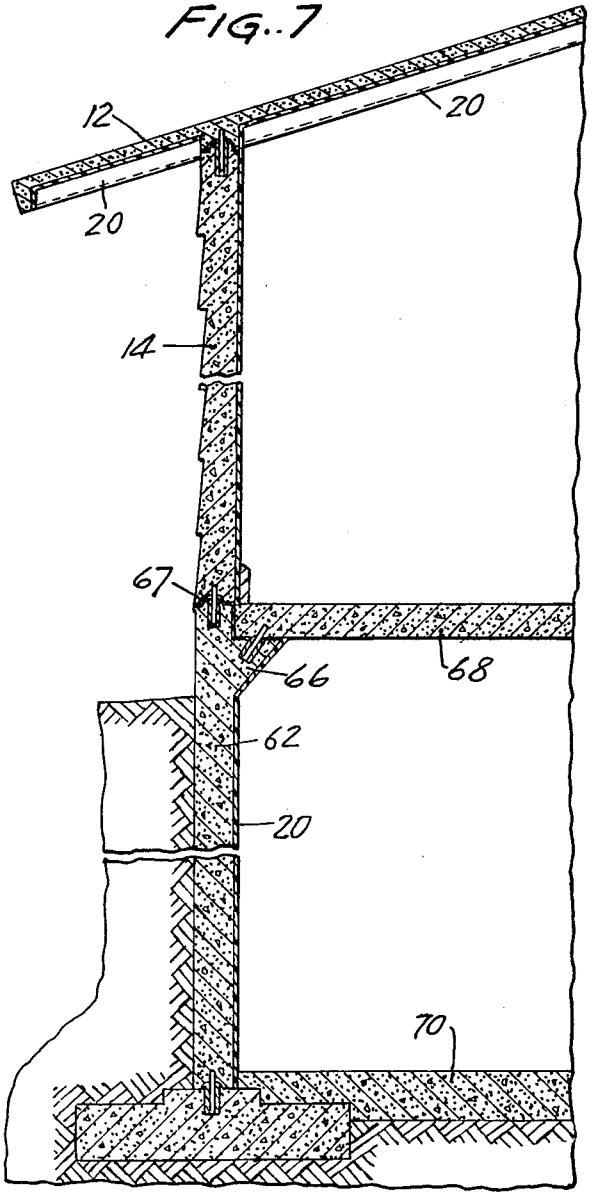
FIG. 7 shows another building panel of the invention having a support member, useful for supporting a floor structure, and shows the manner in which such panel is used.

In FIG. 7 there is shown a cross-sectional view of a portion of a building structure comprising wall panel 62 (shown as a basement wall) resting upon corner footing 64. Wall panel 62 has on one surface thereof support member 66 which is integral with panel 62 and which is adapted to support a floor structure 68. The top edge of panel 62 is bevelled so as to form a tongue-in-groove connection with recess 67 in upper wall panel 14. Support member 66 is located somewhat below the top edge of the panel 62 (e.g., about 4 to 10 inches below depending upon the thickness of the floor structure) and preferably forms a continuous shelf along the entire width of panel 62 for the purpose of supporting floor structure 68. Typically support member 66 is triangular in cross-section and projects about 4 to 8 inches outwardly from panel 62. Upper wall panel 14 supports one end of roof panel 12. Basement floor 70 covers footing 64 and the bottom edge of panel 62. When the basement floor 70 is poured after wall panel 62 is in erect position the concrete flows under panel 62 and helps to support such panel along its entire length, thus eliminating the need for additional footings.

Figure 8:
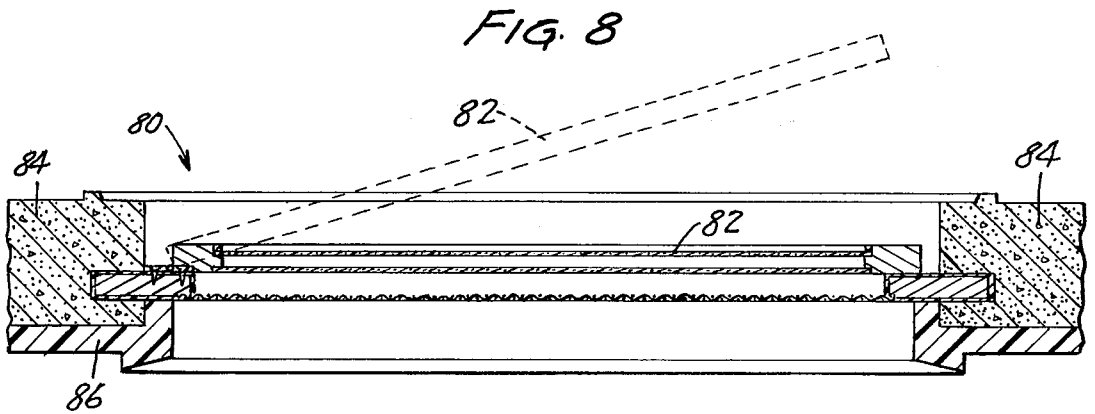
FIG. 8 shows another building panel having a window opening therein, a layer of foam on one surface forming frame and trim around the window.

In FIG. 8 there is shown a portion of a wall panel 80 having an opening therein for a window 82. The wall panel 80 has a concrete core 84 and an interior surface which is covered by a layer of foam 86 which is typically about one-half to one inch thick. Since foam 86 forms the frame and trim around window 82 there is no need to use conventional wood or metal for these purposes. Consequently the problems and expense associated with the use of conventional wood or metal are avoided. After assembly of the building the foam is simply painted or otherwise decorated. Foam layer 86 also serves as the insulation for wall panel 80.

Wall panel 80 is easily made by either of two simple methods. In one method a mold having an appropriately shaped inner surface is first covered with a layer of foam (e.g., by placing or spraying the wet ingredients for the foam into the mold followed by in situ formation of the foam). Wet concrete is then poured into the mold and cured while in contact with the foam so as to bond firmly thereto. In another method wet concrete is first poured into an appropriately shaped mold and cured. The resulting concrete slab is then positioned in close proximity to, but spaced from , an appropriately shaped mold. The wet ingredients for the foam are then injected into the space between the concrete slab and the mold so that the foam will bond to one surface of the concrete and will also take on the shape of the mold. A useful variation of this technique is to position conventional decorative panelling (e.g., wood) or other interior wall surfacing material adjacent to the inside surface of the mold so that the foam, when foamed in place, will bond the panelling or other material to the concrete wall.

Figure 9:
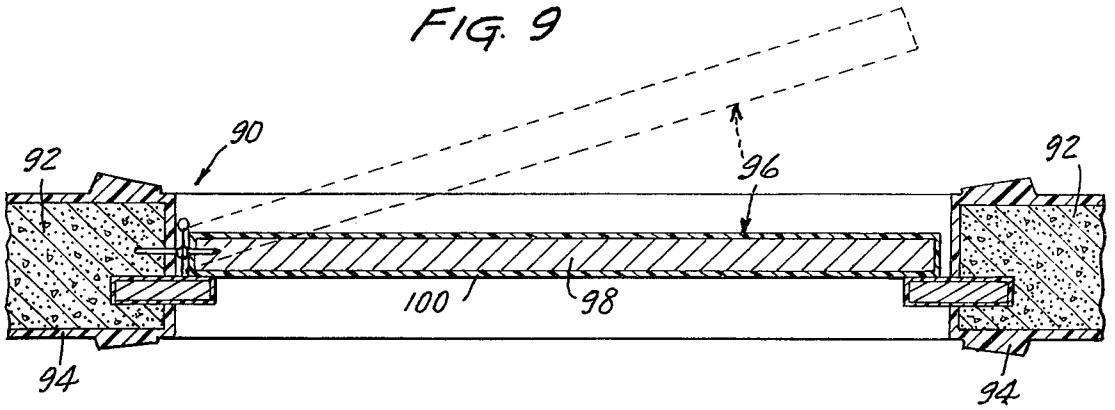
FIG. 9 shows a building panel having a door opening therein, a layer of foam on both surfaces forming frame and trim around the door opening.

In FIG. 9 there is shown a wall panel 90 (useful as an interior wall of a building) comprising concrete core 92 covered on both surfaces or encapsulated by foam layer 94. Panel 90 has an opening therein for door 96. Foam layers 94, typically about one-quarter to one inch thick, form the frame and trim around door 96. The door 96 is comprised of concrete core 98 and foam layer 100 which completely encapsulates core 98.

Wall panel 90 is typically made by first preparing concrete core 92 in an appropriately shaped mold, followed by positioning core 92 in a larger mold having the desired shape for the foam layer. The wet ingredients for the foam are then injected into the space between the core 92 and the mold so that the resulting foam will have the desired configuration.

When making the wall panels it is preferable to embed (or partially embed) any desired electrical conduit in the concrete before curing so that the completed wall structure has the desired electrical paths therein.

Figure 10:
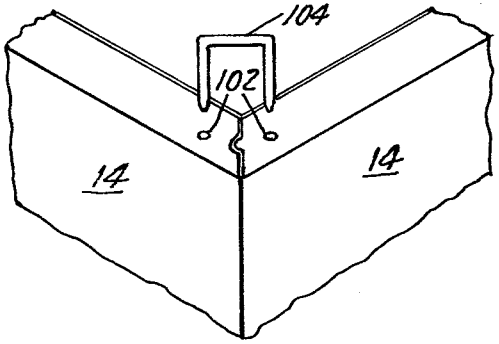
FIG. 10 shows one manner in which wall panels may be interconnected at a corner of a building structure.

In FIG. 10 there is shown one manner in which wall panels 14 may be interconnected at a corner of a building structure. One panel edge is shown with a groove therein which is adapted to receive or mate with a complementary shaped tongue on the edge of the other panel. Holes or recesses 102 are formed in the top of panels 14 as shown in such a manner that U-shaped fastener 104 will fit therein and hold panels 14 together.

Other variants are possible without departing from the scope of this invention.

What is claimed is:

1. A roof structure comprising a plurality of concrete building panels supported, by a supporting means, in abutting edge-to-edge relationship, each said building panel having a downwardly projecting rib extending along each of two opposite side edges on the bottom surface of said panel, each said rib being integral with said bottom surface, a layer of foam covering said bottom surface and extending around each said rib so as to at least partially cover said opposite side edges of said panel, wherein the thickness of each rib is greater at said bottom surface of said panel than at the projecting end of said rib, wherein abutting edges of said panels are received in and supported by a V-shaped notch in said supporting means, whereby said foam on said abutting edges of said plurality of panels is compressed so as to form a seal.

2. A roof structure in accordance with Claim 1, wherein each said panel is rectangular in shape and said ribs are parallel to each other.

3. A roof structure in accordance with Claim 1, wherein said foam is polyurethane foam.

4. A roof structure in accordance with Claim 1, wherein at least one pin is partially embedded in said bottom surface of each said panel at an oblique angle.

5. A roof structure in accordance with Claim 1, wherein one end of each said panel supports a projecting step, integral with said panel, which is adapted to be supported by, and connect to, a central support beam, and wherein the top of said projecting step is adapted to support, and mate with, one end of a roof panel having a complementary configuration.

6. A method for interconnecting abutting ends of roof panels of the type which are supported by a central beam, wherein the method comprises the steps of:

a. positioning one end of a first roof panel on said central beam, said end of said panel having a projecting step, integral with said panel, which is adapted to be supported by, and connect to, said central beam, and said end being covered by a layer of foam, b. connecting said end of said first roof panel to said central beam.

c. positioning one end of a second roof panel solely on said projecting step of said first roof panel, wherein said end of said second roof panel is complementary to said end of said first roof panel and is adapted to connect thereto, said end of said second panel being covered by a layer of foam, d. connecting said end of said second roof panel to said end of said first roof panel by means of a pin and a tongue-in-groove connection, whereby said foam on said ends is compressed so as to form a seal.

7. A method in accordance with claim 6 comprising connecting said first roof panel to said central beam by means of a pin and a tongue-in-groove connection.

* * * * *